US005860558A

United States Patent [19]

Fahy

[11] Patent Number: 5,860,558

[45] Date of Patent: Jan. 19, 1999

[54] ICE RESTRAINING DEVICE

[76] Inventor: Gregory M. Fahy, P.O. Box 2517, Gaithersburg, Md. 20886

[21] Appl. No.: 784,023

[22] Filed: Jan. 15, 1997

Related U.S. Application Data

[63] Continuation-in-part of Ser. No. 472,494, Jun. 7, 1995, abandoned.

[51] Int. Cl.[6] ..... A65D 23/00

[52] U.S. Cl. ..... 320/719; 220/731

[58] Field of Search ..... 220/719, 731

[56] References Cited

U.S. PATENT DOCUMENTS

| | | | |
|---|---|---|---|
| 2,357,063 | 8/1944 | Swing | 210/163 |
| 3,920,146 | 11/1975 | Baller | 220/90.4 |
| 4,938,375 | 7/1990 | Fantacone | 220/719 |
| 4,938,377 | 7/1990 | Jarvis | 220/216 |
| 5,150,816 | 9/1992 | DeCastro | 220/711 |
| 5,379,914 | 1/1995 | Martins | 220/719 |
| 5,702,024 | 12/1997 | Riso | 220/719 |

*Primary Examiner*—Joseph M. Moy
*Attorney, Agent, or Firm*—Price, Heneveld, Cooper, DeWitt & Litton

[57] ABSTRACT

An ice restrainer for mounting on a container rim. The restrainer includes a fitting adapted to be mounted to one discreet segment of the container rim and a rigid barrier pivotally attached to the fitting. The platform is repositionable between a first functioning position within the container interior for restraining and submerging ice in a beverage contained within the container wherein the barrier is adapted to permit the flow of liquids therebeyond while retaining solid objects therebehind when the container is tipped. The platform has a second non-functioning position wherein the barrier is positionable at an angle inclined from horizontal when the container is upright for replenishment of ice without removal of the fitting from the container rim.

13 Claims, 6 Drawing Sheets

ICE RESTRAINING DEVICE

This application is a continuation-in-part of U.S. patent application Ser. No. 08/472,494 filed on Jun. 7, 1995, entitled "ICE RESTRAINING DEVICE" which is hereby incorporated herein by reference, now abandoned.

BACKGROUND OF THE INVENTION

The present invention relates to devices that retain ice or similar objects in beverage glasses, cups, or similar containers while permitting free flow of liquid beverage from the containers. More particularly, the present invention relates to ice retaining devices that retain ice but not liquid in the same container when the container is tipped or inverted.

A common problem associated with the consumption of a beverage containing ice cubes is that the ice cubes float on the surface of the beverage and therefore come in contact with the lips of the drinker. In addition to this problem, the ice cubes often greatly impede the flow of the beverage into the drinker's mouth, frustrating the drinker's desire simply to drink the beverage, rather than maneuver around ice cubes with his or her lips. When one tips the glass up to enhance the flow of liquid, the ice may come rushing toward the drinker, spilling the contents of the container on the drinker, particularly when the drinker is attempting to consume the final sip or two of the beverage and tilts the container at an extreme angle.

Previous adaptations of beverage container covers or of ice retaining devices either came in unwanted contact with the lips of the drinker, such as in elastically mounted container covers, did not provide for proper flow of liquid remaining in the container, required the user to physically hold the retainer in place upon the container to prevent the retainer from being dislodged from the container, or failed to guarantee stability of the ice retaining member so as to reassure the user that ice will be effectively retained when the container is inverted and shaken.

SUMMARY OF THE INVENTION

In the present invention, an ice restrainer is provided for mounting on a container rim. The restrainer includes a fitting adapted to be mounted to one discreet segment of the container rim and a rigid. The platform is repositionable between a first functioning position within the container interior for restraining and submerging ice in a beverage contained within the container wherein the barrier is adapted to permit the flow of liquids therebeyond while retaining solid objects therebehind when the container is tipped. The platform has a second non-functioning position wherein the barrier is positionable at an angle inclined from horizontal when the container is upright for replenishment of ice without removal of the fitting from the container rim.

A second aspect of the present invention is an ice restrainer for mounting on a discreet segment of the container rim including a platform for submerging within the container and below the container rim and adapted to permit the flow of liquids therebeyond while retaining solid objects therebehind. At least one hairpin clip is affixed to a periphery of the platform, the clip including two legs connected by a bight at an end opposite from the platform and forming a slot for gripping and receiving a wall of the container therebetween, and at least one support leg is positioned at a periphery of the platform.

These and other objects, advantages, and features of the present invention will become apparent upon review of the following specification in conjunction with the drawings.

DETAILED DESCRIPTION OF THE PREFERRED EMBODIMENTS

Figure 3:
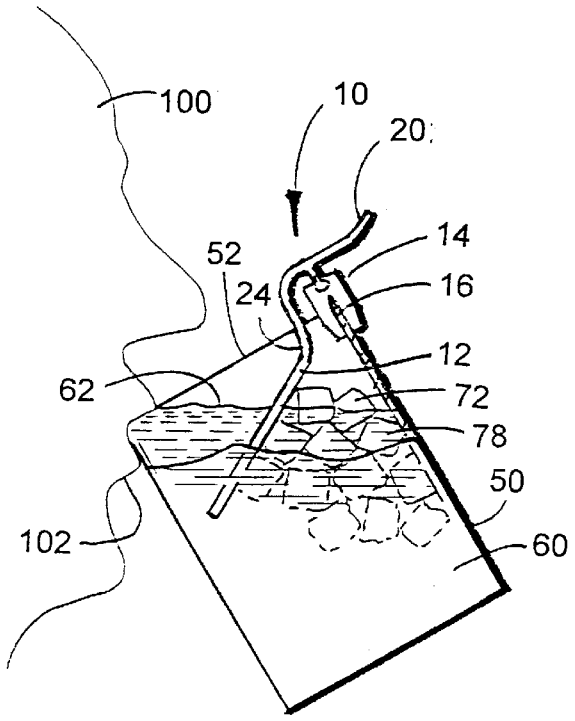
FIG. 3 is a perspective view of a person drinking from a glass using one embodiment of the ice restraining device of the present invention.
Figure 10:
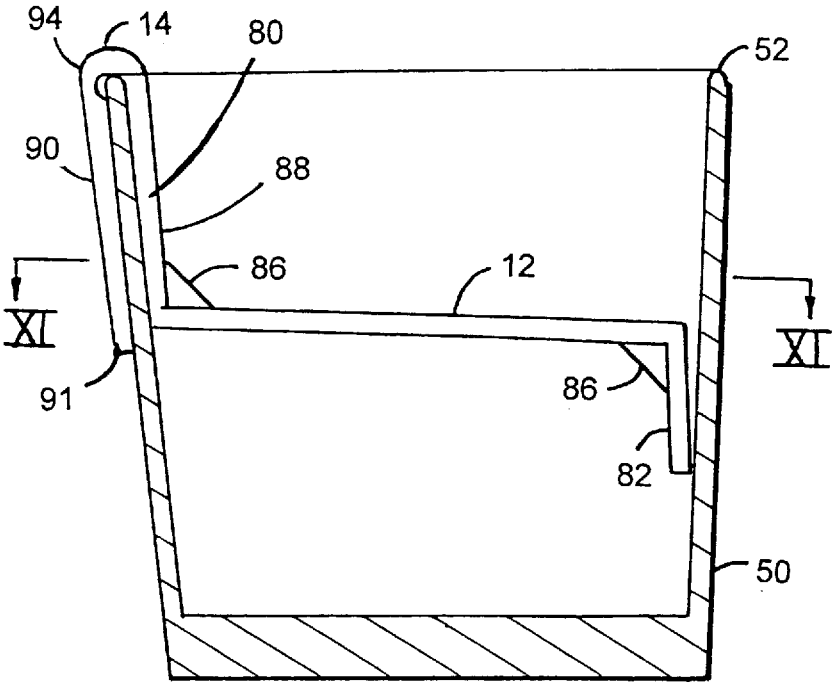
FIG. 10 is an elevational view of an ice restrainer according to the present invention showing the restrainer in a conical glass with the glass shown in section.

For the purposes of description herein, the terms "upper," "lower," "right," "left," "rear," "front," "vertical," "horizontal," and derivatives thereof shall relate to the invention as oriented in FIGS. 3 and 10. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
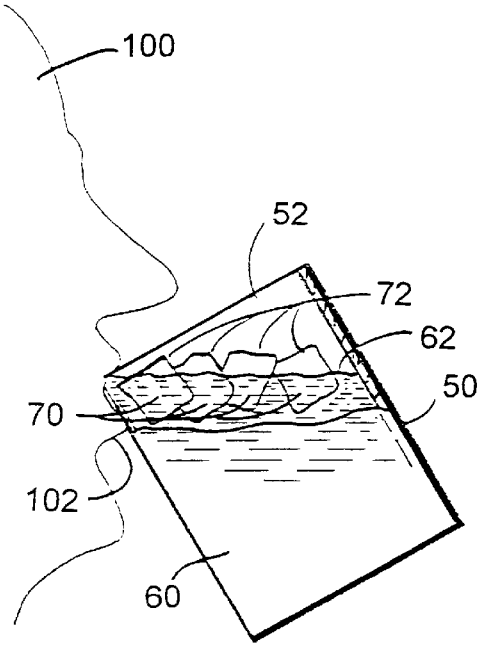
FIG. 2 is a perspective view of a person drinking from a glass with no ice restrainer.

FIG. 2 shows the problems of drinking beverages without the ice restraining device of the preferred embodiment. The attempt to drink the beverage 60 brings ice 70 toward the lips 102 of the drinker 100, thus blocking the flow of beverage 60 into the drinker's mouth and frequently bringing the ice 70 into unwanted contact with the drinker's lips 102. Because the ice floats, a portion of its surface 72 protrudes above the surface 62 of the beverage 60, which reduces its effectiveness in cooling the liquid, particularly near the bottom of the glass 50.

FIG. 3 schematically shows the action of one embodiment of the present invention in preventing the problems shown in FIG. 2. The ice 70 remains away from the drinker's mouth at all times and is mostly submerged completely, exposed surfaces 72 being minimal. Further, in the embodiment shown, the tilt of barrier 12 ensures that ice is present near the surface 62 whether the glass is tilted for drinking or is in a resting position. Ice 70 is retained by barrier 12 which is situated below rim 52 of glass 50 by standoff 24. Handle 20 with standoff 24 is in turn affixed to rim 52 of glass 50 by means of clip 14. The handle 20 is used to pivot barrier 12 about pivot bar 22 held within upper groove 18. Beverage 60 is also more sufficiently cooled near the bottom of glass 50.

In the preferred embodiments, an ice restraining device is provided, depicted by the reference numeral 10 in FIGS. 1 and 3–12. Like elements of alternate embodiments are like identified in the figures. Restrainer 10 includes a barrier 12 for restraining the ice within the beverage container and a clip 14 for mounting restrainer 10 onto the rim 52 of container 50.

Figure 11:
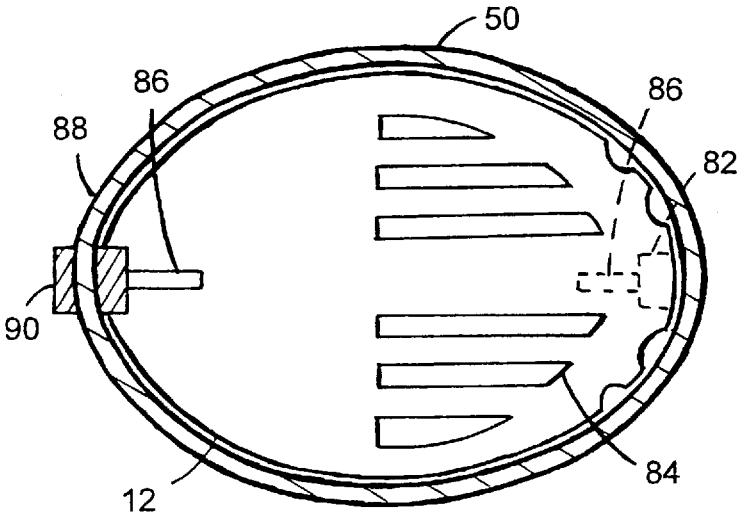
FIG. 11 is a sectional view of the retainer of FIG. 10 taken along lines XI—XI.
Figure 12:
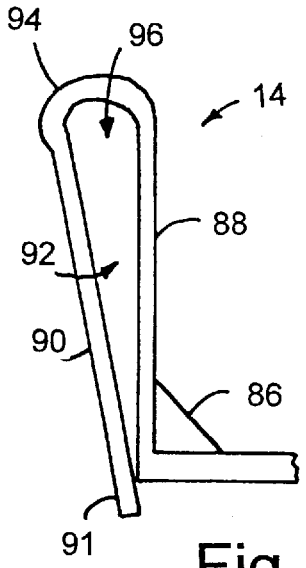
FIG. 12 is an enlarged view of the hairpin clip for gripping the glass edge.

In the most preferred embodiment, as shown in FIGS. 10–12, the ice restraining device 10 is shown affixed to rim 52 of glass 50 (shown in cross section in FIG. 10). Ice restraining device 10 comprises a platform 12 having a plurality of apertures 84 therethrough. Apertures 84 may be of varying shapes, sizes and arrangements to add a variety of aesthetic characteristics to restrainer 10, and are not limited to the generally rectilinear apertures shown in FIG. 10. In lieu of apertures 84 through platform 12, an irregular or loose fitting periphery can be formed about platform 12 thereby providing areas for liquid to flow around.

Hairpin clip 14 is affixed to the periphery of platform 12 and comprises support leg 88 and biasing leg 90 joined by bight portion 94 at a top portion thereof and form slot 92 therebetween. Support leg 88 and biasing leg 90 are typically not parallel one with respect to the other, but rather are convergent in nature wherein free end 91 of biasing leg 90 is biased toward support leg 88. Bight portion 94 is non-linear with respect to leg 90 thereby forming bulbed area 96 at a top portion of slot 92. Bulbed area 96 is slightly larger than slot 92 for receiving the rim of glass 50, in part because some glasses such as glass 50 have a beaded rim 52, thus requiring bulbed area 96 to be slightly larger than slot 92. Hairpin clip 14 'locks' onto glass 50 when rim 52 is received in slot 92 and bulbed area 96, and restrainer 10 is held in position on glass 50 by the gripping action of leg 90 biased toward support leg 88 thereby generating a gripping force against the sides of glass 50. In general, the gripping action is facilitated by bulbed area 96 maintaining the upper portions of legs 88 and 90 separated at a greater distance than the thickness of the sides of glass 50.

Leg 88 of restrainer 10 is preferably affixed to a peripheral portion of platform 12 at an angle other than a right angle such as shown in FIG. 10. Gusset 86 is positioned at the intersection of leg 88 and platform 12 to provide rigidity between leg 88 and platform 12 thereby minimizing flexing of platform 12 with respect to leg 88. A support leg 82 depends downwardly from platform 12 at a position generally diametrically opposed to leg 88. The intersection of platform 12 and support leg 82 is also braced against flexing with gusset 86.

In use, ice restrainer 10 is vertically lowered into glass 50 until rim 52 is firmly received in bulbed area 96, thereby submerging any ice floating in the beverage contained within glass 50. As glass 50 is tipped or inverted, the ice will bear upon a lower surface of platform 12 thereby imparting a longitudinal force along the axis of glass 50 toward rim 52. The force of the ice there imparted tends to flex platform 12 with respect to leg 88 and to create a gap between the wall of glass 50 and platform 12 in the area of support leg 82 for ice to escape from glass 50. Gusset 86 braces against leg 88 to resist the flexing. Furthermore, gusseted support leg 82 interferes with the side of glass 50 in an area diametrically opposed to leg 88 further resisting the unsupported end of platform 12 from flexing and rotating about the intersection of leg 88 and platform 12 and thereby preventing ice from escaping from between platform 12 and the side of glass 50.

Figure 13B:
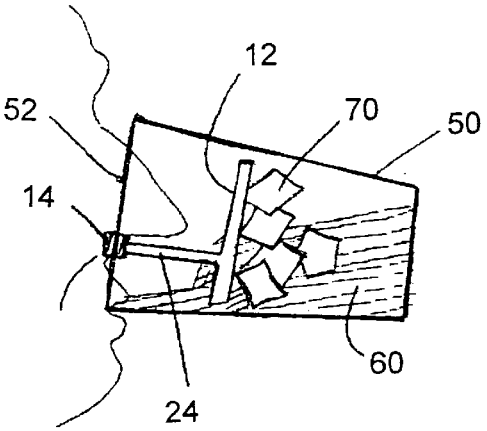
FIG. 13*b* is a side view of the restrainer of FIG. 13*a* shown in position relative to the facial features of a drinker.
Figure 13A:
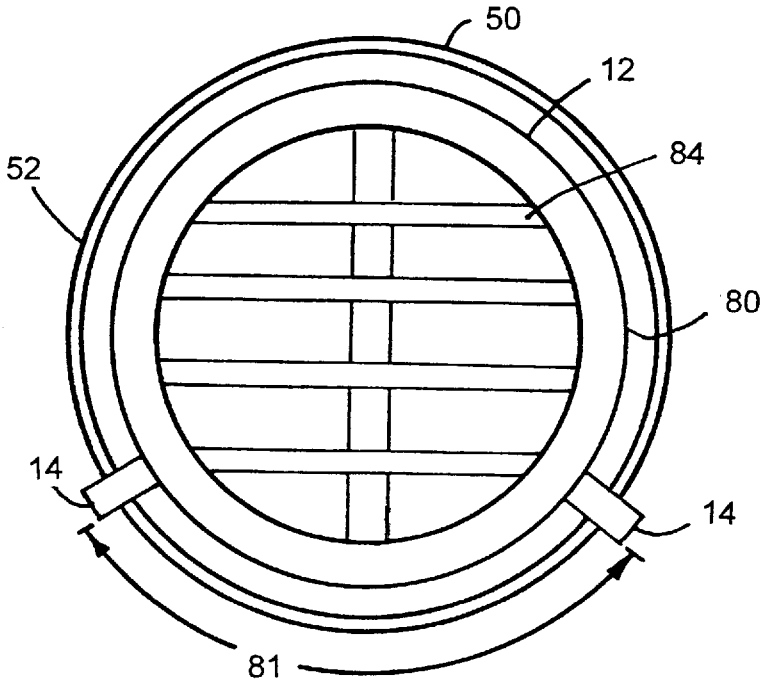
FIG. 13*a* is a top view of a restrainer comprising two hairpin clips for retaining the restrainer on a glass.

Turning now to FIGS. 13*a* and 13*b*, a variation of restrainer 10 is shown wherein two hairpin clips 14 are positioned at an angle 81 about the periphery of platform 12, and both hairpin clips engage rim 52 of glass 50. By immobilizing platform 12 at two sites rather than one site only, the tendency of platform 12 to rotate relative to either clip 14 is greatly reduced, as each individual clip 14 tends to prevent rotation of the platform 12 relative to the other clip 14. The provision of an extra clip 14 enhances the grip between restrainer 10 and glass 50, thereby greatly diminishing the possibility of accidental dislodgement from glass 50.

As shown in FIG. 13*b*, the presence of a clip 14 at a position corresponding to the brow of a drinker is eliminated. Location of clip 14 at the brow of a drinker may cause worry concerning possible collision between clip 14 and the drinker's brow. There are natural alternative locations for the dual clips 14 of the embodiment of FIGS. 13*a* and 13*b*. As shown in FIG. 13*b*, one site is adjacent to the nasolabial folds of the drinker. These natural indentations in the drinker's face provide comfortable and non-visually distracting locations for clips 14. The second site (not shown) is adjacent to the facial contours near the drinker's eyes. The contours of the face near the eyes involve indentations sufficient to accommodate clips 14. Further, locating the clips at approximately 180 degrees from each other maximally suppresses the potential flexing between barrier 12 and clips 14. However, one skilled in the art will recognize that alternate locations and numbers of clips 14 are contemplated by the preferred embodiment.

In an alternate embodiment as shown in FIGS. 1 and 3–5, clip 14 includes a narrow lower groove 16 which allows attachment of restrainer 10 to the rim 52 of a beverage container such as a glass 50 by gripping rim 52 of glass 50 tightly. Clip 14 is typically made of plastic, and has enough flexibility to admit rim 52 of glass 50 into lower groove 16 but enough stiffness to grip rim 52 snugly. It is also preferably sufficiently flexible and sufficiently short in length, that it can be flexed to accommodate the different curvatures of different sized glasses. The length of clip 14 extends only a fraction of the circumference of the glass, not all of the way around it. Indeed it preferably extends just a sufficient distance to give it a good grip on the edge of the glass, but not so far that it cannot be flexed to accommodate different sized glasses having different curvatures. The depth of lower groove 16 is sufficient to ensure an adequate grip and is typically about ¼ to ½ inch. In other embodiments, clip 14 may also be secured by means of a knurled thumbscrew, or clip 14 may be an adjustable clamp similar to a paper clamp.

Figure 1:
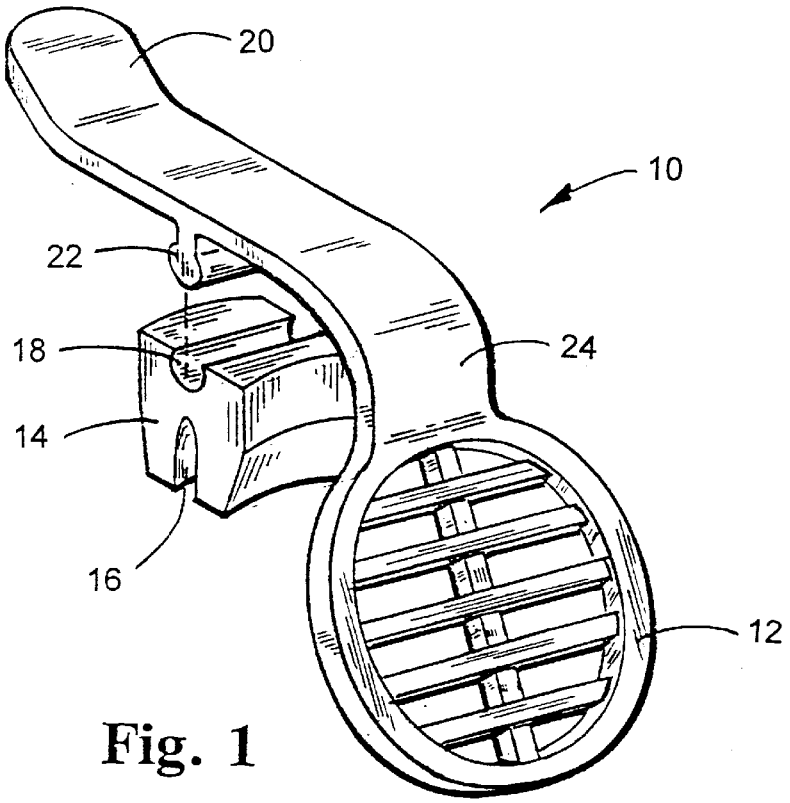
FIG. 1 is a perspective view of one embodiment of the ice restraining device of the present invention.

FIG. 1 further shows that although the clip 14 and lower groove 16 are slightly curved to match the curve of rim 52 of glass 50, clip 14 also has an upper groove or pivot slot 18 which is straight to permit pivoting. There is sufficient body in clip 14 to permit a straight groove 18 to be superimposed on the curved clip 14.

In this embodiment retainer 10 includes a handle 20. Attached to handle 20 is pivot bar 22, and standoff 24 is positioned between handle 20 and barrier 12. Handle 20 and clip 14 snap together by placing pivot bar 22 into upper groove 18. The fit between upper groove 18 and pivot bar 22 is moderately tight. This allows handle 20 and barrier 12 to remain in whatever position they are placed in by the user. By pressing downward on handle 20, the user can tilt barrier 12 upward and even out of the glass 50 to permit more ice to be added to the beverage. By lifting upward on handle 20, the user can submerge barrier 12 to the desired degree, thereby submerging ice held below barrier 12. Because the fit between groove 18 and bar 22 is somewhat snug, the buoyancy of ice below barrier 12 is not enough to lift barrier 12 upwards. For embodiments in which barrier 12 cannot be tilted upward high enough to permit ice to be added to the glass, handle 20 and barrier 12 can be temporarily disconnected from clip 14 (either by vertical or horizontal motion relative to clip 14), or clip 14 can be detached from the glass temporarily to permit ice to be replenished.

Figure 1A:
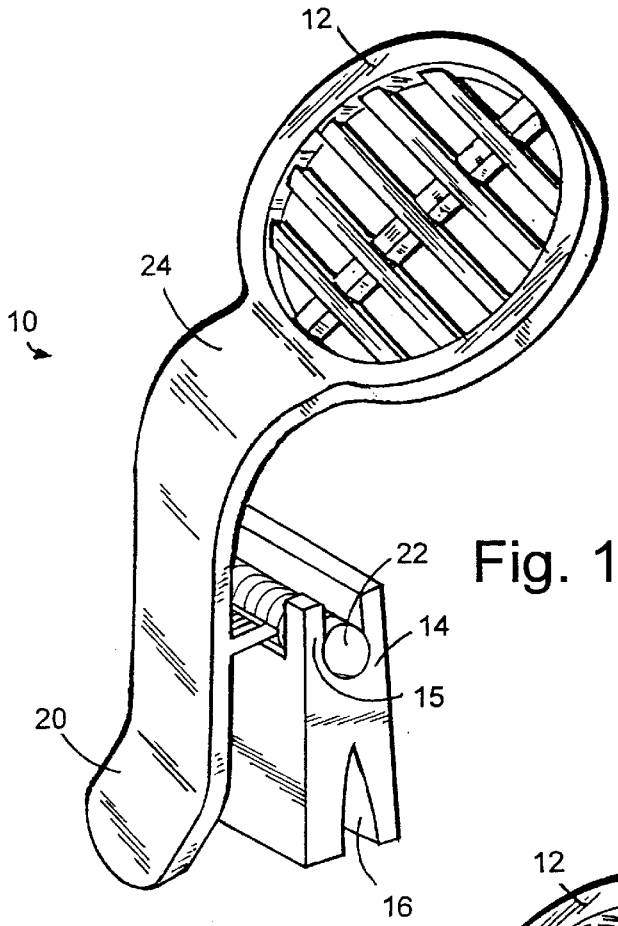
FIG. 1*a* is a perspective view of a modified embodiment of the ice restraining device of FIG. 1.
Figure 1B:
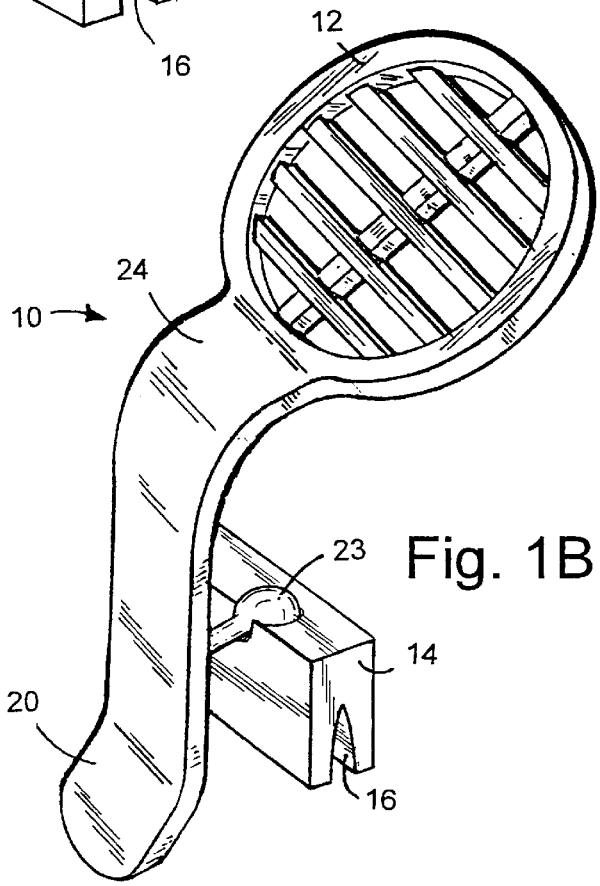
FIG. 1*b* is a perspective view of a further modified embodiment of the ice restraining device of FIG. 1.
Figure 4:
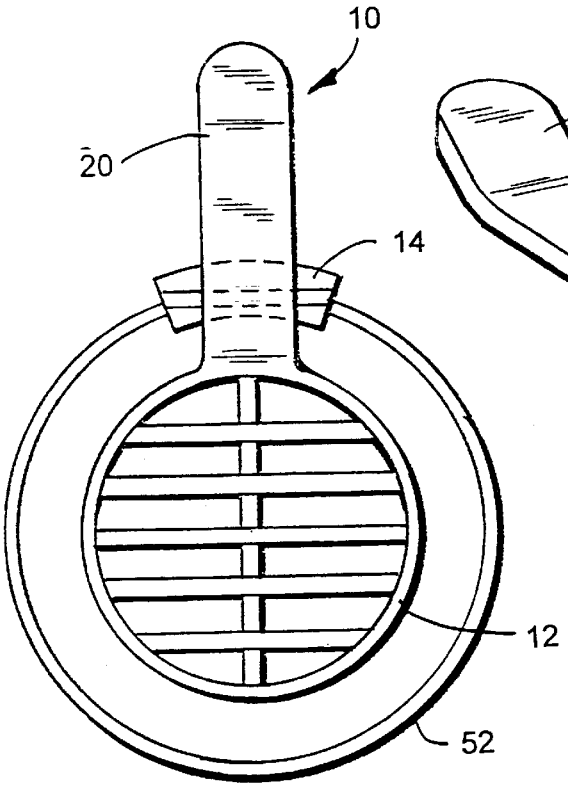
FIG. 4 is a top view of a glass with the ice restraining device.

The design of pivot bar 22 and upper groove 18 may vary. As shown in FIG. 1*a,* the rear wall 15 of upper groove 18 may be partially cut away so as not to block the motion of handle 20 when it is pushed down sufficiently to lift barrier 12 completely out of glass 50. Pivot bar 22 may also be a ball-shaped or spherical pivot member 23, as shown in FIG. 1*b,* with groove 18 being a ball-shaped or spherical cavity having a circular inner cross section.

Because the weight of a glass is considerable, particularly when it contains a beverage, one may, with one hand, lift upward or push downward on handle 20 readily with minimal risk of tipping over the glass. For this reason, when the glass is first filled and ice is in position, the beverage can be stirred by moving handle 20 up and down to cool the beverage residing above the barrier 12, thus ensuring that the beverage reaching the drinker is ice cold despite absence of ice above barrier 12.

Figure 5:
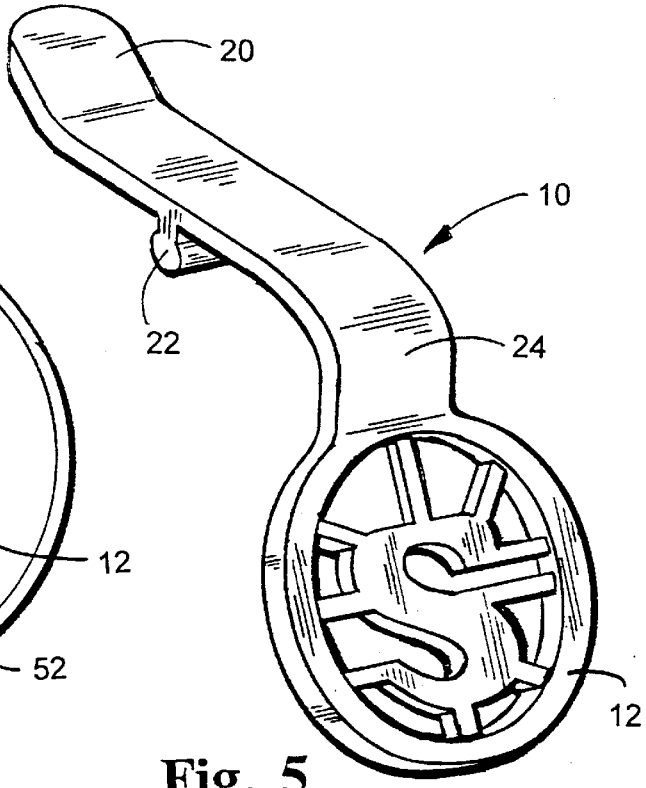
FIG. 5 is a perspective view of an alternate barrier design.

The exact design of barrier 12 may vary. FIG. 1 depicts a simple grid design; FIG. 5 depicts a barrier based on the dollar sign. Barrier 12 may contain cartoon or superhero or action figure promotional patterns and images, or corporate logos, for the amusement of children and adults. The only requirement is that large ice cubes are not allowed to cross the barrier. An unlimited number of surface shapes, even including surfaces without openings, and even including non-planar shapes, may provide satisfactory ice retaining function.

The depth of the barrier 12 in the glass may be set by manufacturing handle 20 and barrier 12 with different vertical standoff 24 lengths to suit different tastes. A typical standoff 24 length may be ½ inch to 2 inches. The angle formed between standoff 24 and barrier 12 need not be the angle shown in FIGS. 1 and 3, but may be a right angle or even an angle less than 90 degrees.

Additionally, the diameter of the barrier 12 can vary to accommodate glasses of different sizes and shapes. Because barriers can be interchangeable, the user may optionally purchase barriers 12 and fittings 14 separately and combine them as desired.

Certain glasses have flat rather than curved edges. For such glasses, the design described in FIG. 1 is modified to omit curvature of clip 14. Further, in such cases barrier 12 may be more square or polygonal than circular so as to correspond to the shape requirements imposed by the particular glass.

Figure 6:
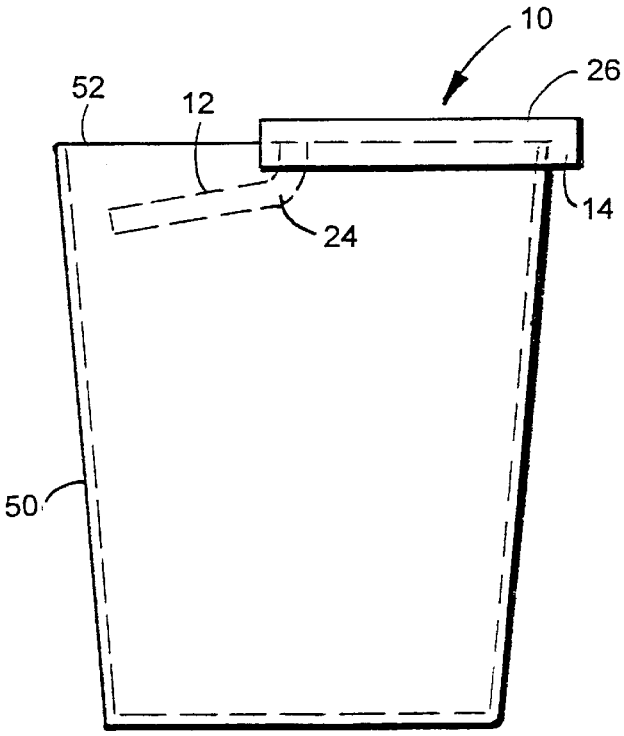
FIG. 6 is a side view of a second embodiment of the ice restraining device of the present invention.
Figure 7:
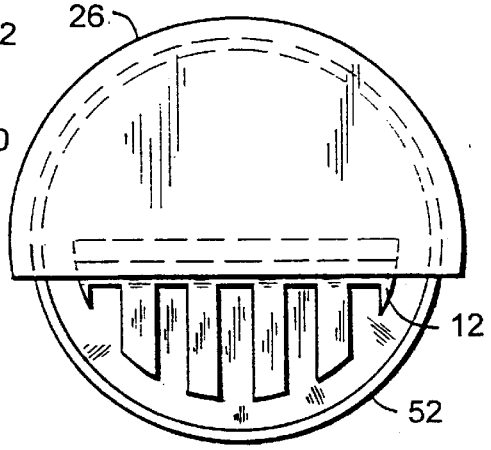
FIG. 7 is a top view of the ice restraining device shown in FIG. 6.

Another embodiment of the present invention is shown in FIGS. 6 and 7. In this embodiment, clip 14 is expanded to a semi-circular shape and includes cover 26. In this embodiment, cover 26 provides a means of avoiding spillage of the beverage, and the greater contact area of clip 14 with rim 52 of glass 50 provides further security of positioning of clip 14. Standoff 24 may be attached to clip 14 without pivoting capability, or pivoting capability analogous to that described above may be provided. In the embodiment shown in FIGS. 6 and 7, submerged barrier 12 may cover less than the majority of the cross-sectional area of the glass interior. Alternatively, cover 26 may be "horseshoe" shaped to provide room for the drinker's nose to enter the glass.

Figure 8:
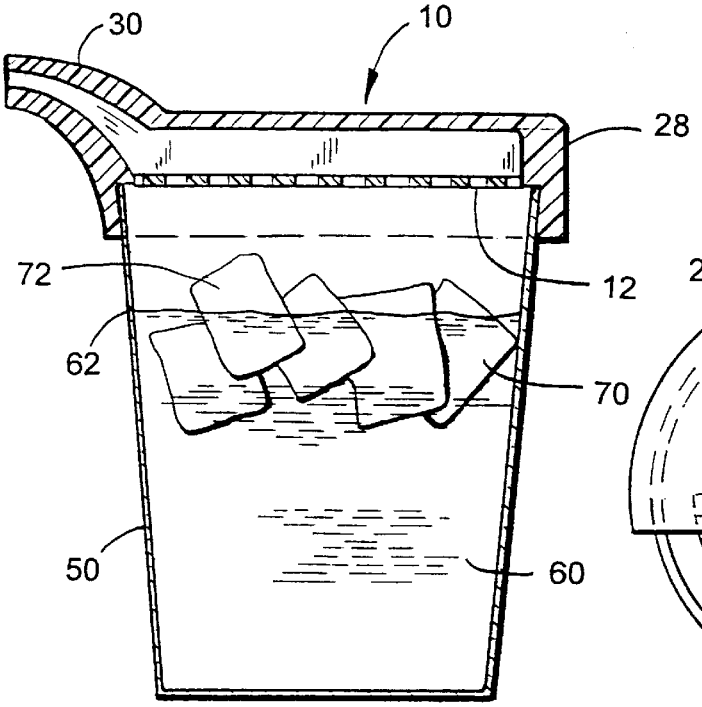
FIG. 8 is a side view of a third embodiment of the ice restraining device of the present invention.

A further embodiment is shown in FIG. 8. In this embodiment, barrier 12 is located at approximately the level of rim 52 of glass 50 and is enclosed in a housing 28 that fully encloses the opening of glass 50. The user drinks the beverage not by placing his or her lips on rim 52 of the glass 50, but by using spout 30. In this embodiment, the glass is rendered spill-proof by housing 28 except for the area of the spout 30. Barrier 12 may be positioned at or above the level of rim 52, or may be placed below rim level by attaching a standoff to the bottom of housing 28 which is in turn attached to barrier 12.

Although snap-on caps with spouts are known in the prior art, they are not generally contemplated for use in preventing ice from reaching the drinker and would be of minimal effectiveness in this regard because both large ice cubes and crushed ice tend to block spout 30 due to the absence of barrier 12. Barrier 12, in FIG. 8, allows beverage 60 to pass freely to the drinker without restriction from large ice cubes, overcoming the problem of the narrow neck of spout 30 that in known snap-caps may be blocked by ice.

Figure 9:
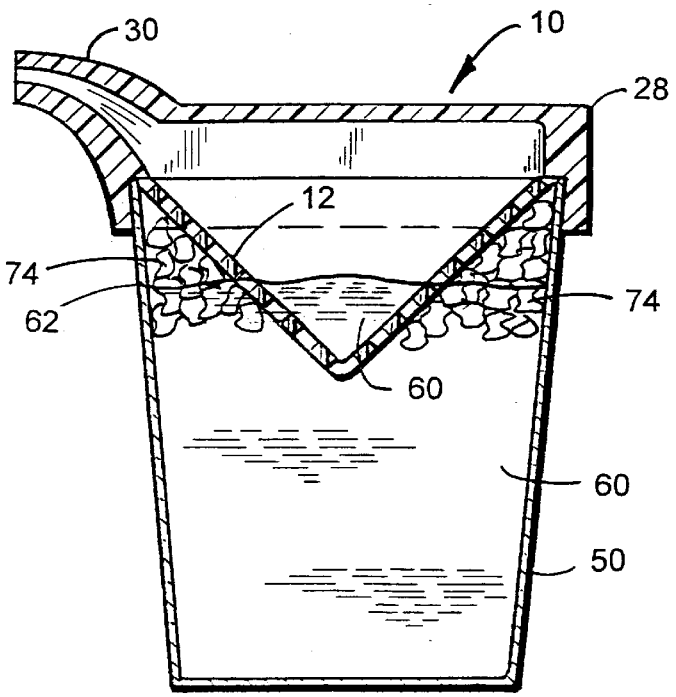
FIG. 9 is a side view of a modified version of the third embodiment shown in FIG. 8.

In a modified form of the latter embodiment, as illustrated in FIG. 9, barrier 12 can be effective for both blocking the movement of crushed ice 74 toward the drinker and for permitting the passage of beverage 60 through the barrier 12 by making use of a sloped or conical barrier 12. This feature provides not only more surface area for beverage filtration through the crushed ice 74 but may also provide a passageway through the crushed ice 74 itself as shown in FIG. 9, thus greatly facilitating drinking.

The above description is considered that of the preferred embodiments only. Modifications of the invention will occur to those skilled in the art and to those who make or use the invention, which is defined by the following claims as interpreted according to the principles of patent law, including the Doctrine of Equivalents.

The embodiments of the invention in which an exclusive property or privilege is claimed are defined as follows:

1. An ice restrainer for mounting on a container having a rim defining an opening to an interior of the container, said restrainer comprising:

a platform for submerging within the container and below the container rim and adapted to permit the flow of liquids therebeyond while retaining solid objects therebehind;

at least one hairpin clip affixed to a periphery of said platform including two clip legs connected by a bight at an end opposite from said platform and forming a slot therebetween for gripping and receiving a wall of the container; and at least one support leg positioned at a periphery of said platform.

2. The ice restrainer of claim 1, wherein said support leg is one of said hairpin clip legs and further comprising:

a gusset at the intersection of said platform and said support leg.

3. The ice restrainer of claim 1, wherein said bight forms a bulbed portion in conjunction with said slot for receiving the container rim.

4. The ice restrainer of claim 1 wherein:

said at least one hairpin clip comprises two hairpin clips; and said at least one support leg comprises two support legs, each of said support legs being one leg of each of said hairpin clips.

5. The ice restrainer of claim 4 further including a gusset at the intersection of said platform and at least one of said support legs.

6. The ice restrainer of claim 4, wherein said hairpin clips are generally diametrically opposed about said periphery for supporting said platform in a fixed relationship with the container.

7. The ice restrainer of claim 4, wherein said hairpin clips are positioned about said periphery of said platform at an angle other than 180 degrees one from the other.

8. The ice restrainer of claim 4, wherein each of said hairpin clips are positioned to correspond to opposite nasolabial folds of a potential drinker.

9. The ice restrainer of claim 4, wherein each of said hairpin clips are positioned to correspond to opposite facial contours near a potential drinker's eyes.

10. The ice restrainer of claim 1, wherein said at least one support leg is two support legs, a first of said support legs being one leg of said hairpin clip and a second of said support legs depending downwardly from said platform.

11. The ice restrainer of claim 10, wherein said downwardly depending support leg is generally diametrically opposed to said hairpin clip.

12. The ice restrainer of claim 10 further including a gusset at the intersection of said platform and at least one of said support legs.

13. The ice restrainer of claim 10 further including a gusset at the intersection of said platform and each of said support legs.

* * * * *